US007762865B2

(12) United States Patent
Gelfond et al.

(10) Patent No.: US 7,762,865 B2
(45) Date of Patent: Jul. 27, 2010

(54) CRIB MOBILE WITH ANIMATED CHARACTERS

(75) Inventors: Lisa Ellen Gelfond, Chicago, IL (US); Dianne Elizabeth Lauble, Chicago, IL (US); Randall Jon Klimpert, Wilmette, IL (US)

(73) Assignee: Infantino, LLC, San Diego, CA (US)

( * ) Notice: Subject to any disclaimer, the term of this patent is extended or adjusted under 35 U.S.C. 154(b) by 846 days.

(21) Appl. No.: 11/626,246

(22) Filed: Jan. 23, 2007

(65) Prior Publication Data

US 2008/0176480 A1 Jul. 24, 2008

(51) Int. Cl.
*A63H 33/00* (2006.01)

(52) U.S. Cl. ..... 446/227; 446/81; 446/318

(58) Field of Classification Search ..... 446/227
See application file for complete search history.

(56) References Cited

U.S. PATENT DOCUMENTS

| | | | | | |
|---|---|---|---|---|---|
| 1,770,455 | A | * | 7/1930 | Berger | 446/318 |
| D147,776 | S | | 11/1947 | Backelman | |
| 3,638,602 | A | | 2/1972 | Carreno | |
| 3,927,482 | A | | 12/1975 | Marcus | |
| 3,978,610 | A | | 9/1976 | Stubbman | |
| 3,983,647 | A | | 10/1976 | Stubbmann | |
| D278,446 | S | | 4/1985 | Kujawski et al. | |
| 4,600,399 | A | * | 7/1986 | Abe | 446/242 |
| 4,878,869 | A | * | 11/1989 | Yamane et al. | 446/130 |
| 4,904,220 | A | * | 2/1990 | Williams et al. | 446/227 |
| 4,973,286 | A | * | 11/1990 | Davison | 446/175 |
| 5,112,268 | A | | 5/1992 | Klaus | |
| D349,735 | S | | 8/1994 | Cacciola et al. | |
| 5,620,274 | A | | 4/1997 | Wear | |
| 5,803,786 | A | | 9/1998 | McCormick | |
| 5,951,360 | A | * | 9/1999 | Fearon et al. | 446/227 |
| 6,068,535 | A | | 5/2000 | Hoyt | |
| 6,089,944 | A | * | 7/2000 | Bergkvist | 446/227 |
| 6,464,594 | B1 | * | 10/2002 | Canna et al. | 472/119 |
| 6,629,727 | B2 | * | 10/2003 | Asbach et al. | 297/188.21 |
| 6,705,950 | B2 | * | 3/2004 | Wood et al. | 472/118 |
| 7,025,654 | B2 | | 4/2006 | Oren et al. | |

(Continued)

FOREIGN PATENT DOCUMENTS

| | | |
|---|---|---|
| GB | 2019229 | 10/1979 |

*Primary Examiner*—Gene Kim
*Assistant Examiner*—Joseph B Baldori
(74) *Attorney, Agent, or Firm*—Stetina Brunda Garred & Brucker

(57) ABSTRACT

A crib mobile comprises a base assembly, a support bar mounted on the base assembly, and a body assembly mounted on the support bar, The body assembly includes a motor for rotating a support frame. The support frame has a clover-leaf configuration comprising a plurality of contiguous lobes each having a circularly opening. A plurality of character elements are mounted on each of the lobes and are rotatable thereabout. The character elements simulate the appearance of an animal figure and may include peripheral portions which are pivotally attached to the character element and are rotatable relative to one another. Each of the character elements includes a musical instrument and a movable member for simulating the playing of the musical instrument in response to gravitational forces acting upon the movable member during rotation of the support frame. The base assembly produces preprogrammed music during the simulated playing of the musical instruments.

18 Claims, 7 Drawing Sheets

U.S. PATENT DOCUMENTS 7,264,534 B2 * 9/2007 Stubenfoll ..... 446/227
7,470,167 B2 * 12/2008 Clark ..... 446/227
2005/0287909 A1 * 12/2005 Gelfond ..... 446/227

* cited by examiner 81,88
58
56
10
78
100
60,62
50
84,90
64
66
48
50
52
50
52
50
50
50
50
54
20
34,36
28
26
30
22
40
32

54
20
22
46
26
42
40
32
44
38

54
20
46
26
28
22,24

Guitar Remote

CRIB MOBILE WITH ANIMATED CHARACTERS

CROSS-REFERENCE TO RELATED APPLICATIONS (Not Applicable)

STATEMENT RE: FEDERALLY SPONSORED RESEARCH/DEVELOPMENTS (Not Applicable)

BACKGROUND OF THE INVENTION

The present invention relates generally to toys for infants and, more particularly, to a crib mobile that is detachably mountable to an infant's bed or crib and which is specifically adapted to support a plurality of character elements on a rotatable support frame having sufficient rigidity in order to allow support of generally heavier character elements and to allow greater movement and articulation options for such character elements for visual stimulation of an infant. The crib mobile is also adapted to provide visual stimulation through musical instruments which are attached to the character elements and which, during rotation of the support frame, are "played" in simulated fashion by the character elements. The simulated "playing" of the musical instrument may occur in concert with preprogrammed music that is transmitted through speakers included with the crib mobile.

As is well known to parents, commonly found in many nurseries are mobiles which are attached to an infant's crib. These mobiles are typically attachable to a portion of the crib such as a crib railing. Some mobiles are provided with a wind-up musical element or music box component that is operative to play a melody while simultaneously rotating a portion of the crib mobile. Traditionally, crib mobiles include elongate plastic arms that are suspended from the music box component with each of the plastic arms having interesting and visually stimulating devices dangling therefrom.

It is common practice to provide such visually stimulating devices (i.e., toys, stuffed animals, etc.) to entertain the infant when confined to certain situations such as a crib or in a baby chair, a car seat or a playpen. In such confined situations, it is desirable that the chosen device enhances the developmental capabilities of the infant. In addition, it is known that providing a familiar toy or device for the infant may even serve to soothe and calm the infant in certain situations.

In the interest of providing character elements that can capture an infant or young child's interest, it is desirable that such character elements are capable of a variety of movement options with greater articulation such that the infant may be left unattended for lengthier periods of time without adult interaction. Included in the prior art are a variety of infant mobile configurations which include various character elements dangling therefrom but which may be limited in the amount of movement. The limitations in movement may be due to a lack of the necessary joints that must be incorporated into the character element but which may be necessarily omitted due to strength limitations of the support frame from which the character elements may be suspended.

As such, there exists a need in the art for a crib mobile which may be mounted to a crib or bed of an infant and which is specifically adapted to support heavier character elements as compared to crib mobiles of the prior art. In addition, there exists a need in the art for a crib mobile having the capability to support character elements with greater degrees of articulation in order to provide higher degrees of stimulation in comparison to crib mobiles of the prior art.

BRIEF SUMMARY OF THE INVENTION

In accordance with the present invention, there is provided a crib mobile adapted for supporting a plurality of character elements each having peripheral portions which are pivotally mounted thereto in order to provide enhanced visual stimulation to an infant. In addition, the crib mobile is adapted to provide additional stimulation to the infant due to musical instruments that are attached to the character elements and which are "played" by movable member that are also mounted to the character elements.

The movable members move in distinct fashion under the influence of gravity during rotation of a support frame upon which the character elements are mounted. The simulated playing of the musical instruments by the movable members can occur simultaneous with the playing of actual music that may be preprogrammed into the crib mobile. The music is producible by a speaker located in a base assembly of the crib mobile.

The base assembly is specifically adapted for mounting to a support structure such as a railing of a crib or a playpen. The base assembly may include a base housing containing a battery for powering a motor which imparts rotational motion to the support frame. The base assembly includes a clamp mechanism adapted to facilitate removable attachment of the crib mobile to the crib.

The clamp mechanism may include a recess formed in a base housing of the base assembly which is adapted to engage the crib railing. The clamp mechanism may further include a rotatable clamp knob having a threaded shaft which extends axially into the base housing and includes a clamp pad. The clamp pad and recess portion may define a gap therebetween. The clamp pad and recess portion are axially moveable relative to one another in order to clamp the base assembly to the crib railing and secure the crib mobile to the crib.

The base assembly includes an elongate and arcuately-shaped support bar having proximal and distal ends. The support bar extends upwardly from the base portion at its proximal end and terminates at a body assembly mounted on the distal end. The body assembly is comprised of a body housing having a motor contained therewithin. The motor is in electrical communication with a battery such that power may be provided thereto. A drive shaft of the motor protrudes out of the body housing. A support frame is mechanically connected to the drive shaft and supports the character elements thereon.

The support frame is provided in a clover-leaf configuration comprising a plurality of contiguous lobes each having a circular opening formed therein. Each of the lobes is formed by a circularly shaped outer rim having an elongate arm member extending radially inwardly therefrom. The arm member terminates at a general center of the opening and includes means for pivotally mounting the character element thereupon.

Each of the character elements may be configured to simulate the appearance of an animal and, in this regard, may include a body portion and a head portion fixedly secured to the body portion. The head portion may include a pair of peripheral portions which are pivotally attached to the head portion and are themselves configured to simulate the appearance of animal ears. Likewise, the body portion may include a pair of peripheral portions pivotally attached thereto and which are configured to simulate the appearance of animal legs.

Each of the ears and legs of the character elements is adapted to be freely pivotable relative to one another during rotation of the support frame in response to gravitational force acting upon the ears and legs. In this manner, enhanced visual stimulation is provided by the pivotable nature of the peripheral portions in addition to the general rotational nature of the support frame upon which the character elements are mounted.

Each of adjacent pairs of the lobes define a notch therebetween. For the clover leaf configuration of the support frame, three of the lobes are included and define three corresponding notches therebetween. A hollow object may be fixedly or non-movably mounted to the support frame at each one of the notches. Each of the hollow objects may be at least partially filled with a plurality of beads and is preferably configured such that the beads may move in a generally radial direction within each of the hollow objects during rotation of the support frame in response to gravitational forces acting upon the beads.

The movement of the beads may create a noise effect to provide audible stimulation to an infant viewing the rotating character elements in addition to the visual stimulation provided by movement of the beads. As was earlier mentioned, each one of the character elements includes a unique musical instrument such as a drum, a guitar and a flute which play music frame under the influence of gravitational force in response to rotation of the support frame. The music that is played by each of the musical instruments during rotation of the support structure is complementary to music that is produced by a base assembly speaker and which is preprogrammed into the crib mobile.

Regulation of the operation of the crib mobile is by means of a plurality of controls including an on/off switch, nightlight, and a volume control for regulating the music produced by the speaker for playing a variety of different melodies preprogrammed into the crib mobile. Selective activation of one of the control buttons on an outer surface of the base assembly causes the crib mobile to play a particular type of melody such as a classical melody, a flute melody, or a reggae melody.

BRIEF DESCRIPTION OF THE DRAWINGS

These as well as other features of the present invention will become more apparent upon reference to the drawings wherein.

DETAILED DESCRIPTION OF THE INVENTION

Figure 1:
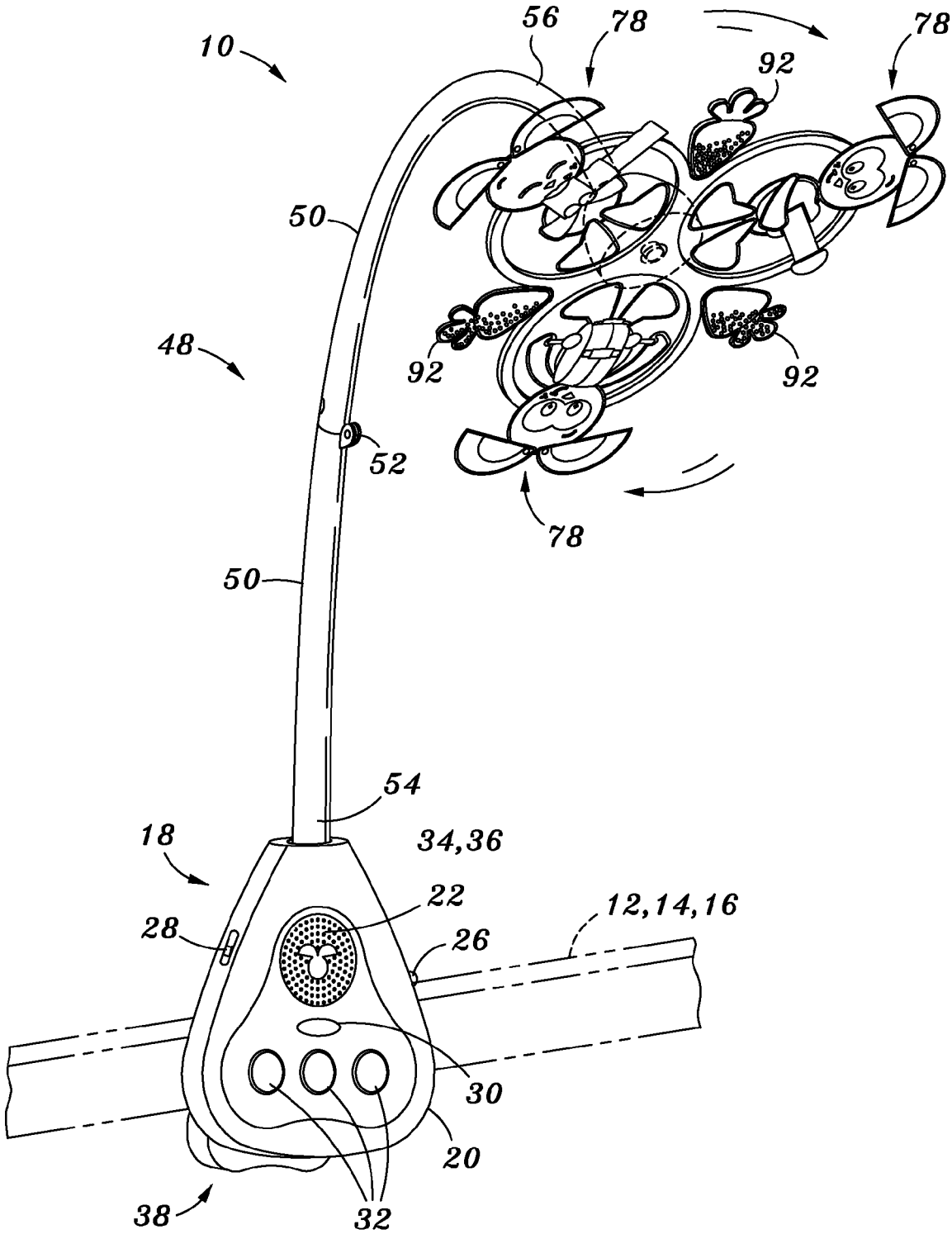
FIG. 1 is a perspective view of a crib mobile secured to a support structure such as a crib railing of a baby's crib.
Figure 2:
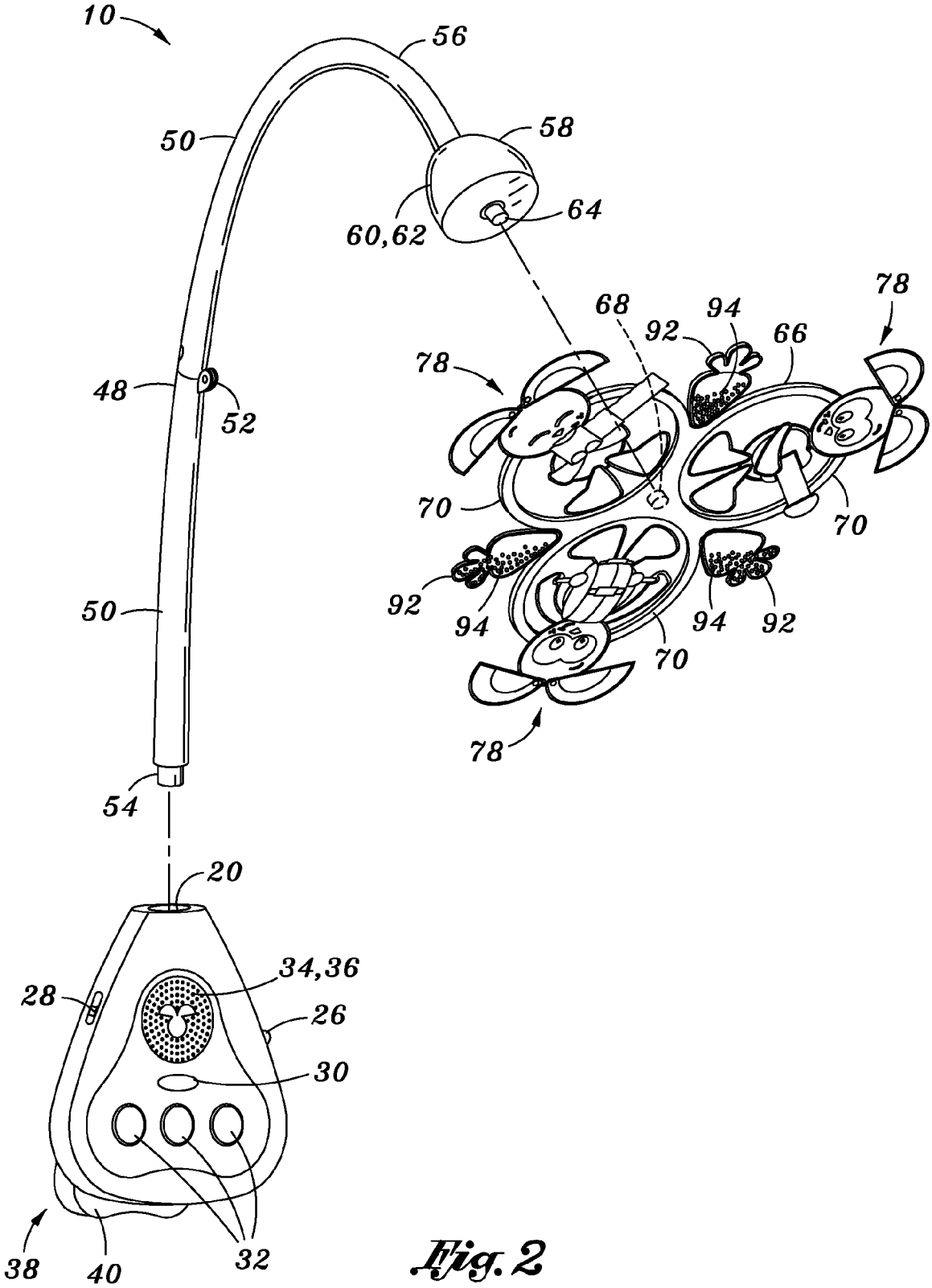
FIG. 2 is a partially exploded perspective view of the crib mobile illustrating a cloverleaf-shaped support frame cooperatively engageable to a body assembly which is mounted on a distal end of a support bar and further including a base assembly adapted to receive a proximal end of the support bar.

Referring now to the drawings wherein the showings are for purposes of illustrating various embodiments of the present invention only and not for purposes of limiting the same, FIGS. 1 and 2 perspectively illustrate a crib mobile 10 constructed in accordance with the present invention. In its broadest sense, the crib mobile 10 comprises a base assembly 18, an elongate support bar 48, and a cloverleaf-shaped support frame 66 cooperatively engaged to a body assembly 58. The support frame 66 is specifically adapted to support a plurality of character elements 78.

Each of the character elements 78 has peripheral portions 84 that are pivotally attached thereto in order to provide a high degree of visual stimulation to an infant during rotation of the support frame 66. In addition, each of the character elements 78 may include a unique musical instrument 100 which is "played" in simulated fashion by distinct movements of the character elements 78 under the influence of gravity during rotation of the support frame 66. The character elements 78 may be configured such that the simulated "playing" of the musical instruments 100 occurs whenever the support frame 66 is set into rotational motion. The crib mobile 10 may further be configured to produce actual music upon command by means of at least one speaker 34 located in the base assembly 18. When activated, the preprogrammed music produced by the speaker 34 may occur simultaneous with the simulated "playing" of the musical instruments 100 by the character elements 78 during rotation of the support frame 66, as will be described in greater detail below.

As can be seen in FIGS. 1-5 the crib mobile 10 may be adapted for mounting on a support structure 14 such as a crib 12 and, more specifically, on a crib railing 16 in such a manner that the character elements 78 are suspended above and generally face toward an infant lying in the crib 12. The crib mobile 10 may be mounted on other suitable support structures 14 including a baby chair, baby stroller, play pen and changing table. The character elements 78 may be provided in variety of shapes and sizes such as in the general likeness of an animal such as a bunny as shown in the figures. Each one of the character elements 78 may further include peripheral portions 84 in a variety of configurations such as in the shape of ears 88 and legs 90. The peripheral portions 84 are preferably pivotally mounted to body and head portions 80, 82 of the character elements 78.

Figures 3, 4, 5:
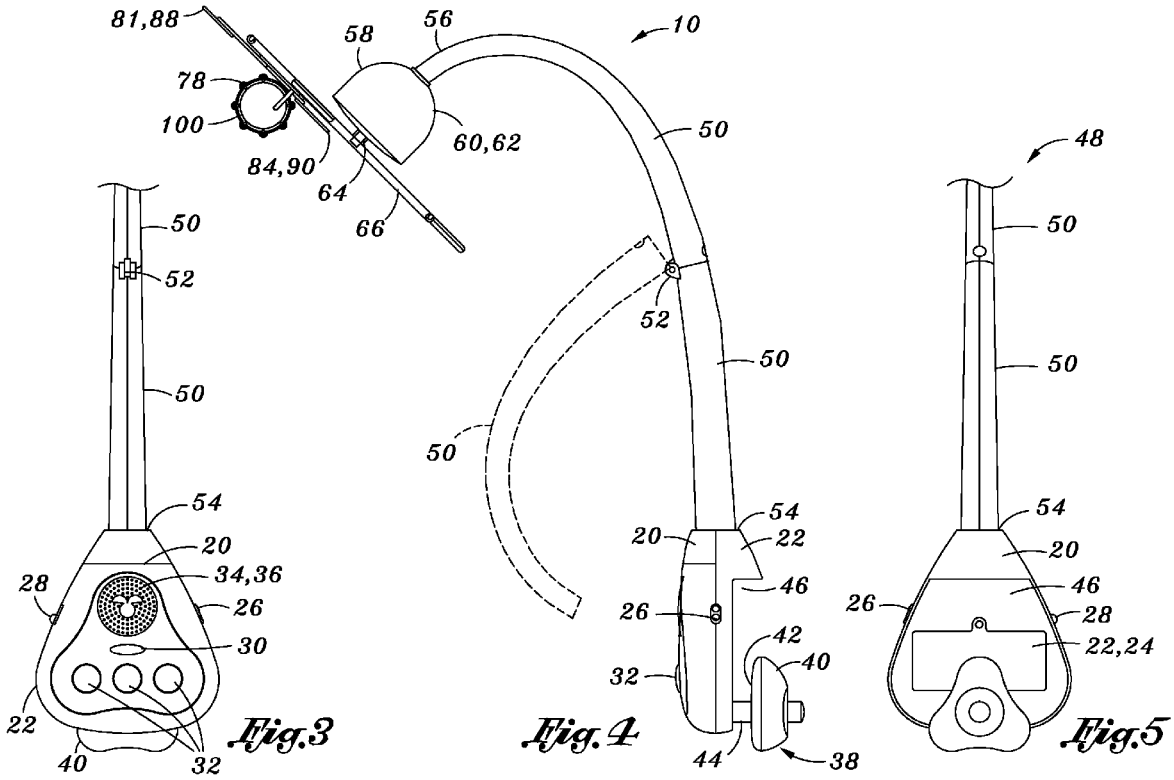
FIG. 3 is a front view of the base assembly and illustrating control buttons, an on/off switch, volume control mounted on a base housing of the base assembly.
FIG. 4 is a side view of the crib mobile illustrating the bar support optionally comprised of a pair of hingedly connected bar portions and a clamp mechanism for mounting the crib mobile to a support structure.
FIG. 5 is a rear view of the base assembly illustrating a battery door for providing access to an interior compartment of the base housing.

The crib mobile 10 is preferably provided in a motorized version wherein the base assembly 18 includes a base housing 20 containing a battery 22 therewithin. The battery 22 may be electrically connected to a motor 62 housed within the body assembly 58 and which is mechanically linked to the support frame 66 for inducing rotational motion thereto when the motor 62 is activated. Due to their pivotal attachment, the peripheral portions 84 rotate relative to one another under the influence of gravity as the support frame 66 rotates to provide an animated quality to the character elements 78 and thereby soothe, calm and entertain the infant As seen in FIGS. 3-5, the base housing 20 may be formed of a pair of mating housing components that collectively define an interior compartment within which the battery 22 is housed. Outer surfaces of the base housing 20 may include a variety of control features including control buttons 32 and/or switches by which the operation of the crib mobile 10 may be regulated. For example, as best seen in FIG. 3, a set of three control buttons 32 are provided on an exteriorly-accessible portion of the base housing 20 in order to selectively cause the crib mobile 10 to play a variety of melodies for a predetermined and/or indefinite period of time. The base housing 20 further contains a speaker 34 in the interior compartment with speaker holes 36 being formed in the base housing 20 and through which the melodies are audibly transmitted.

Each of the control buttons 32 is adapted to cause the playing of a specific melody. For example, pressing the leftmost control button 32 may cause the crib mobile 10 to play a classical melody, pressing the center control button 32 may cause the crib mobile 10 to play a flute melody and pressing the rightmost control button 32 may cause the crib mobile 10 to play a reggae style of melody. However, any melody style can be programmed into the crib mobile 10.

The base assembly 18 may further be provided with a light 30 such as a nightlight 30 to provide a sense of security to an infant sleeping in the crib 12. In addition, the nightlight 30 provides some degree of illumination to a room or to the crib 12 area and may therefore facilitate operation of the crib mobile 10 at night. Other controls that may be provided with the base assembly 18 include an on/off switch 26 and a volume control 28 to regulate the volume level at which the various melodies are played.

The on/off switch 26 is preferably located on a side of the base assembly 18 and when activated, provides power from the battery 22 to the motor 62 and thereby places the support frame 66 and the character elements 78 in rotational motion. The activation of the melody, turning on of the nightlight 30 and activating rotational motion of the support frame 66 may be facilitated when the on/off switch 26 is moved to the on position. However, the crib mobile 10 may be configured to operate in a variety of other modes as will be described in greater detail below.

Referring now to FIG. 4, shown is the support bar 48 which may be configured as a generally arcuately shaped, elongate tubular member having proximal and distal ends 54, 56. The proximal end 54 may include a mounting pin which is engageable to a socket formed in the base assembly 18. The support bar 48 may be comprised of a pair of bar portions 50 which are connectable by a hinge 52 located along a length off the support bar 48. The hinge 52 allows for folding of the bar portions 50 in relation to one another in order to facilitate shipping and storage of the crib mobile 10. The support bar 48 may be fabricated from any suitable material such as any metallic or non-metallic material. Optionally, the support bar 48 may be covered with a soft and/or flexible material such as foam rubber which may, in turn, be covered with fabric.

Referring to FIGS. 3-5, the base housing 20 may include a clamp mechanism 38 which is adapted to allow for removable mounting of the crib mobile 10 to a support structure 14 such as the crib railing 16 shown in FIG. 1. Optionally, the base housing 20 may include a recess 46 formed on a backside thereof and having a generally notch-shaped configuration formed complimentary to a rectangular or square element to which the base assembly 18 may be secured. The clamp mechanism 38 may further include a rotatable clamp knob 40 which may have a threaded shaft 44 extending into the base housing 20.

The clamp knob 40 may itself include a clamp pad 42 which is adapted to engage to the support structure 14 (e.g., crib railing 16) within the recess 46. In this regard, the clamp pad 42 and recess 46 may define a gap therebetween prior to mounting of the crib mobile 10. Rotation of the clamp knob 40 causes axial movement of the clamp pad 42 relative to the recess 46. Tightening of the clamp knob 40 provides a means for securing the base assembly 18 to the support structure 14 such as the crib railing 16 shown in FIG. 1. The clamp knob 40 is preferably ergonomically shaped in order to allow convenient grasping and rotation thereof by a human hand.

Referring to FIGS. 2 and 4, shown is the body assembly 58 which is fixedly mounted on the distal end 56 of the support bar 48. As was earlier mentioned, the motor 62 is preferably contained within the body housing 60 and is in electrical communication with the battery 22 such that power may be provided to the motor 62 during activation thereof via the on/off switch 26 located on the base housing 20. The motor 62 preferably has a drive shaft 64 protruding outwardly from the body housing 60. The support frame 66 is mechanically coupled to the drive shaft 64 such that rotation of the drive shaft 64 results in rotation of the support frame 66 and the character elements 78 mounted thereto.

Figure 6:
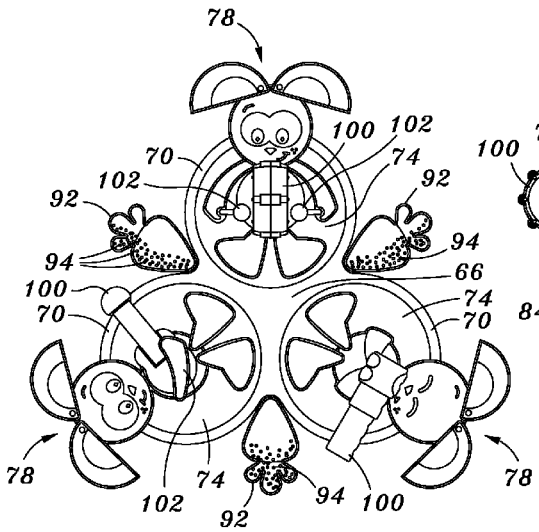
FIG. 6 is a front view of the cloverleaf-shaped support frame having three lobes each supporting a character element thereon.
Figure 8:
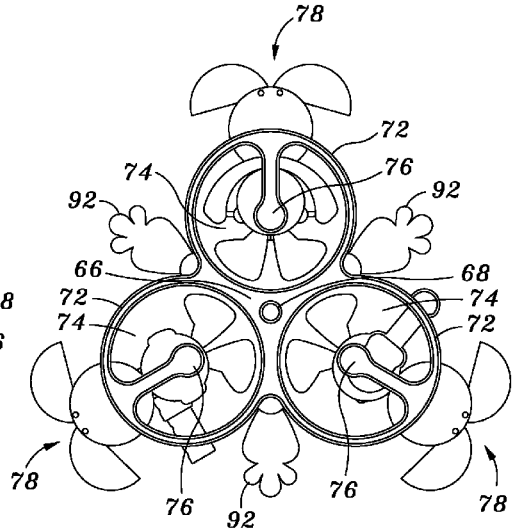
FIG. 8 is a back view of the cloverleaf-shaped support frame comprising three lobes each having a radially inwardly extending arm member for supporting one of the character elements.

As best seen in FIGS. 6 and 8, the support frame 66 is preferably configured in a clover-leaf configuration and comprises a plurality of contiguous lobes 70. The support frame 66 is mounted to the drive shaft 64 of the motor 62 by means of a boss 68 located in a center of the support frame 66. Each of the lobes 70 preferably has a circular opening 74 bounded by an arcuately shaped outer rim 72. As can be seen in FIG. 8, each of the lobes 70 preferably has an arm member 76 which extends radially inwardly from the outer rim 72 toward a general center of the opening. In this regard, the arm member 76 is configured as a generally straight structural element which is preferably radially aligned with the center of the support frame 66. Each of the arm members 76 may have a slightly enlarged or bulbous tip at the terminous end in order to provide sufficient material for pivotal mounting of the character elements 78.

In the embodiment shown, the support frame 66 includes three of the lobes 70 which are preferably oriented at an equi-angular spacing of about one hundred twenty degrees relative to one another. However, any number or lobes 70 may be provided and in any angular spacing. As can be seen in the figures, each of the character elements 78 is supported on the terminous end of a respective one of the arm members 76. In order to adequately support the weight of the character element 78 during rotational movement of the support frame 66, the outer rim 72 and arm member 76 which comprise each of the lobes 70 are preferably sized and configured to provide sufficient strength to resist undue deflection of the arm member 76.

Figure 7:
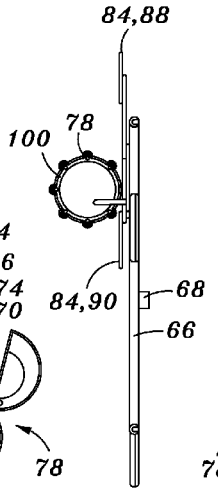
FIG. 7 is a side view of the support frame illustrating one of the character elements mounted thereto.

As can be seen in FIG. 7, the support frame 66 is a planar member and is preferably fabricated of suitably stiff metallic or non-metallic material. In this regard, the support frame 66 is preferably of a unitary construction and may be fabricated from plate stock. The ability to resist deflection during rotational movement of the support frame 66 becomes more important considering the close proximity of the pivoting peripheral portions 84 of the character elements 78 and the outer rim 72 of the lobes 70 to which the character elements 78 are attached.

Regarding the configuration of the character elements 78, each is preferably shaped to simulate the appearance of an animal and, in this regard, may include a body portion 80 and a head portion 82 fixedly secured to the body portion. The body portion 80 may be fixedly secured to the terminous end of the arm member 76. Optionally, body portion 80 may be rotatably or pivotally mounted to the terminous end of the arm member 76. The body portion 80 in combination with the head portion 82 hides or masks the arm member 76 to avoid detracting from the animal appearance of the character elements 78.

The head portion 82 of each of the character elements 78 may include at least one or, more preferably, a pair of the peripheral portions 84 which may be configured to simulate the appearance of animal ears 88. As can be seen in the figures, the animal ears 88 are preferably pivotally attached to the head portion 82 in order to provide additional visual stimulation for the infant. Likewise, the body portion 80 may include a pair of peripheral portions 84 which may be configured to simulate the appearance of animal legs 90 and which are preferably freely pivotal relative to one another in response to gravitational forces acting thereupon during rotation of the support frame 66.

Each of the character elements 78 may be configured in the likeness of a bunny character. As was mentioned above, each of the character elements 78 may further include a unique musical instrument 100. For example, as shown in FIGS. 9 to 11A, one of the bunny characters is provided with a guitar, a second bunny character is provided with a flute and a third bunny character is provided with a drum. Each one of the musical instruments 100 is "played" in simulated fashion by movable members 102 of the bunny character to which the musical instrument 100 is attached as a result of distinct movements of the movable members 102. The distinct movements of the movable members 102 are the result of gravity acting thereupon in response to rotation of the support frame 66 and cause the bunny character 100 to simulate the playing of the musical instrument 100.

Figure 9:
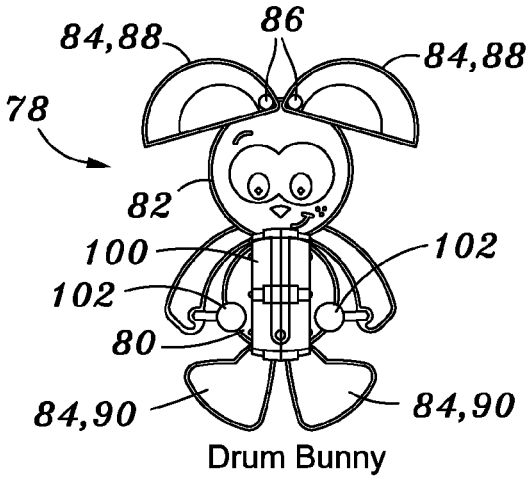
FIGS. 9 and 9A are front and side view, respectively, of one of the character elements configured in the shape of a bunny having a drum mounted thereto and further including peripheral portions in the shape of ears and legs and being pivotally secured to head and body portions of the character element.
Figure 9A:
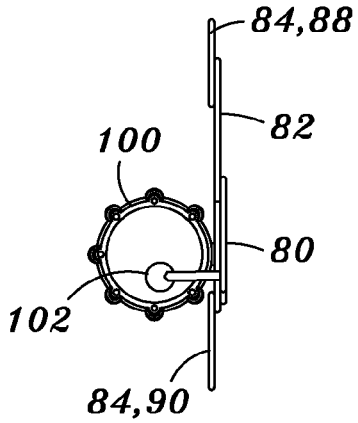

For example, as can be seen in FIGS. 6, 9 and 9A, the bunny character is shown provided with a drum and a pair of movable member 102 disposed on opposing sides of the drum. During rotation of the support frame 66, gravity causes the movable members 102 to simulate the striking of the drum such that it appears that the bunny character is playing the drum. Advantageously, the simulated playing of the musical instruments 100 may occur simultaneous with the playing of actual music produced by at least one speaker 34 located in the base assembly 18. Such music may be preprogrammed into the crib mobile 10 and may comprises several melodies such as a classical melody, a flute melody and/or a baby reggae melody, depending upon which melody is selected for playing.

The melodies produced by the base assembly 18 are preferably relevant to or are complementary in nature to the simulated "playing" of the musical instruments 100 by the character elements 78. The simulated "playing" of the musical instruments 100 combined with the actual playing of music at the base assembly 18 provides enhanced aural and visual stimulation which may further the developmental capabilities of the infant as well as soothe and calm the infant in certain situations.

As may be appreciated, any variety of character elements 78 may be provided in the likeness of any animate or inanimate object. The character elements 78 may additionally include any number and variety of peripheral portions 84 configured to simulate the appearance of various objects. Advantageously, because of the structural integrity provided by the unique configuration of the cloverleaf-shaped support frame 66 in the lobe 70 configuration, each of the character elements 78 may be provided with a large number of peripheral portions 84 which may each be adapted to be pivotally attached to the character elements 78 in order to provide an interesting and stimulating crib mobile 10.

Figure 10:
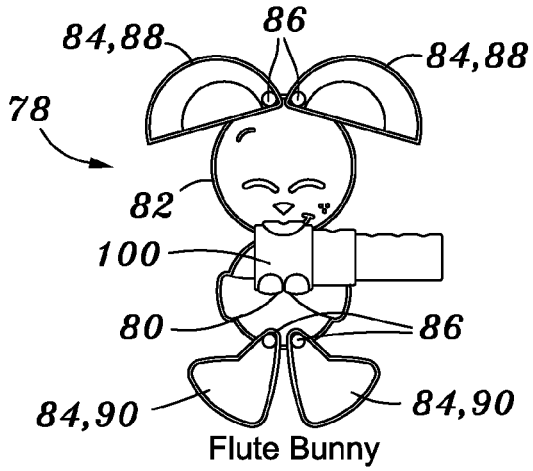
FIGS. 10 and 10A are front and side views, respectively, of one of the character elements in the shape of a bunny having a flute mounted thereto.
Figure 10A:
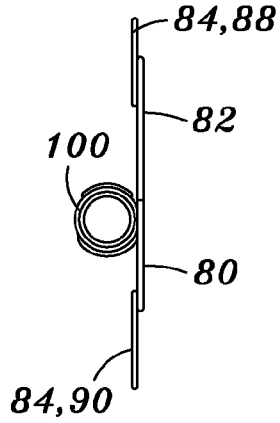
Figure 11:
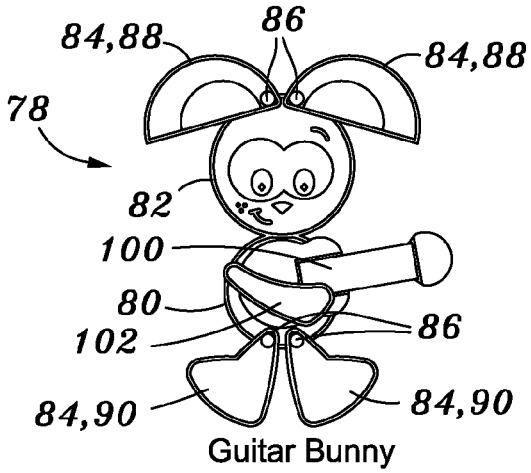
FIGS. 11 and 11A are front and side views, respectively, of one of the character elements in the shape of a bunny having a guitar mounted thereto.
Figure 11A:
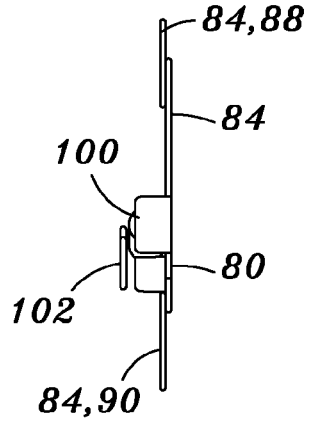
Figure 12B:
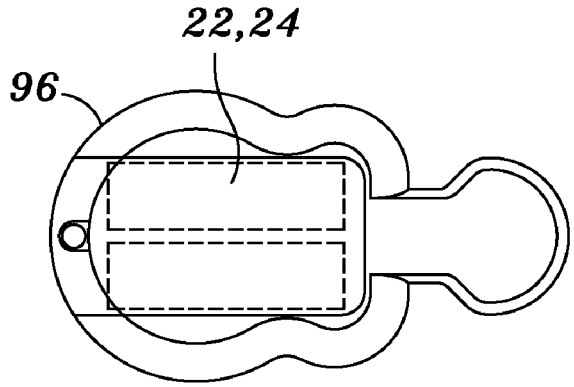
FIGS. 12-12C are front, bottom, side and back views, respectively, of a remote control for wirelessly regulating operation of the crib mobile.
Figure 12C:
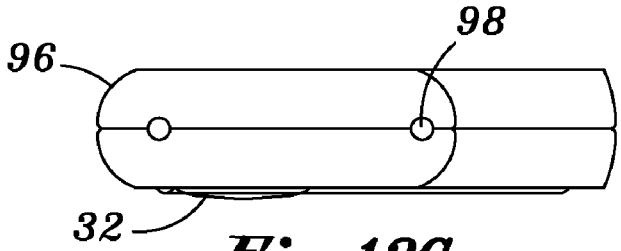
Figure 12A:
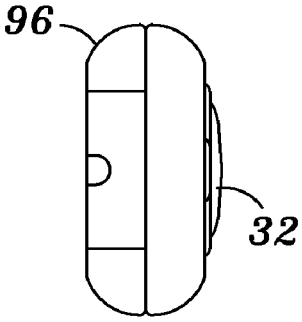
Figure 12:
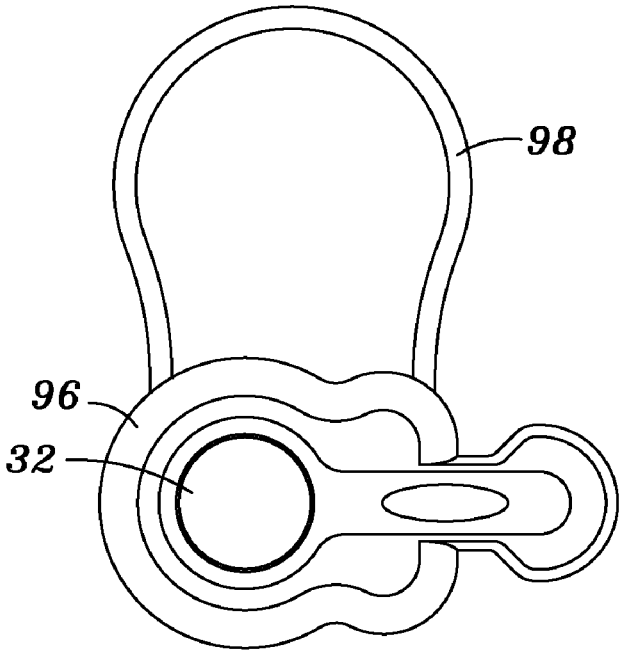

In addition, each of the head and body portions 78, 80 of the character mobile may be provided with various additional elements such as appliqués and other geometric shapes in order to enhance the visual stimulation of the crib mobile 10. For example, as shown in FIGS. 9, 10 and 11, the head portions 82 of each of the character elements 78 may include a pair of eyes, a nose and a mouth in different variations amongst the character elements 78.

In FIGS. 6-8, it can be seen that each of the animal legs 90 is sized to rotate within the opening 74 defined by the outer rim 72 of the lobe. In contrast, the body portion 80 are configured to extend across the outer rim 72 and thereby mask the arm member 76 upon which the character element 78 is supported. The peripheral portions 84 configured as animal ears 88 are attached to the head portion 82 by means of pivot 86 pins and are capable of rotating relative to one another within a wide angular range during the course of a rotational cycle of the support frame 66.

Notably, the support frame 66 defines a plane of rotation during its rotational movement. Each of the character elements 78 may be configured to be rotatable about a plane of rotation that is generally parallel to the plane of rotation of the support frame 66. Furthermore, each of the peripheral portions 84 is also rotatable within a plane of rotation that is parallel to the plane of rotation of the support frame 66. In this regard, it can be seen that a substantial amount of visual stimulation is provided by the various articulated and pivotal movements of the peripheral portions 84.

Referring to FIGS. 1, 2, 6 and 8, the crib mobile 10 may include a plurality of hollow objects 92 for added visual and audible stimulation to the infant. Each one of the hollow objects 92 may be mounted to the support frame 66 at a notch located between adjacent pairs of the lobes 70. Furthermore, each of the hollow objects 92 are at least partially filled with a plurality of beads 94 such that during rotational movement of the support frame 66, the beads 94 move within an interior of the hollow objects 92.

In general, the beads 94 move generally radially back and forth within each of the hollow objects 92 and create a noise that may be soothing and/or stimulating to the infant. The movement of the beads 94 may also provide visual stimulation. The hollow objects 92 may be configured in a variety of shapes and sizes such as the carrot-shaped configuration shown in the figures. The hollow objects 92 are also preferably configured in a generally planar or flat shape in order to avoid interference with other components such as adjacent peripheral portions 84.

Referring to FIG. 11, the crib mobile 10 may be further provided with a remote control 96 as a mechanism for activating or deactivating the crib mobile 10 from a remote location by means of control buttons 32. As can be seen, a handle 98 may also be included with the remote control 96 to facilitate grasping, carrying or hanging of the remote control 96. Although providable in a variety of shapes and sizes, the remote control 96 is shown in the shape of a guitar in coordination with the musical theme of the character elements 78 shown in the figures.

Figure 13:
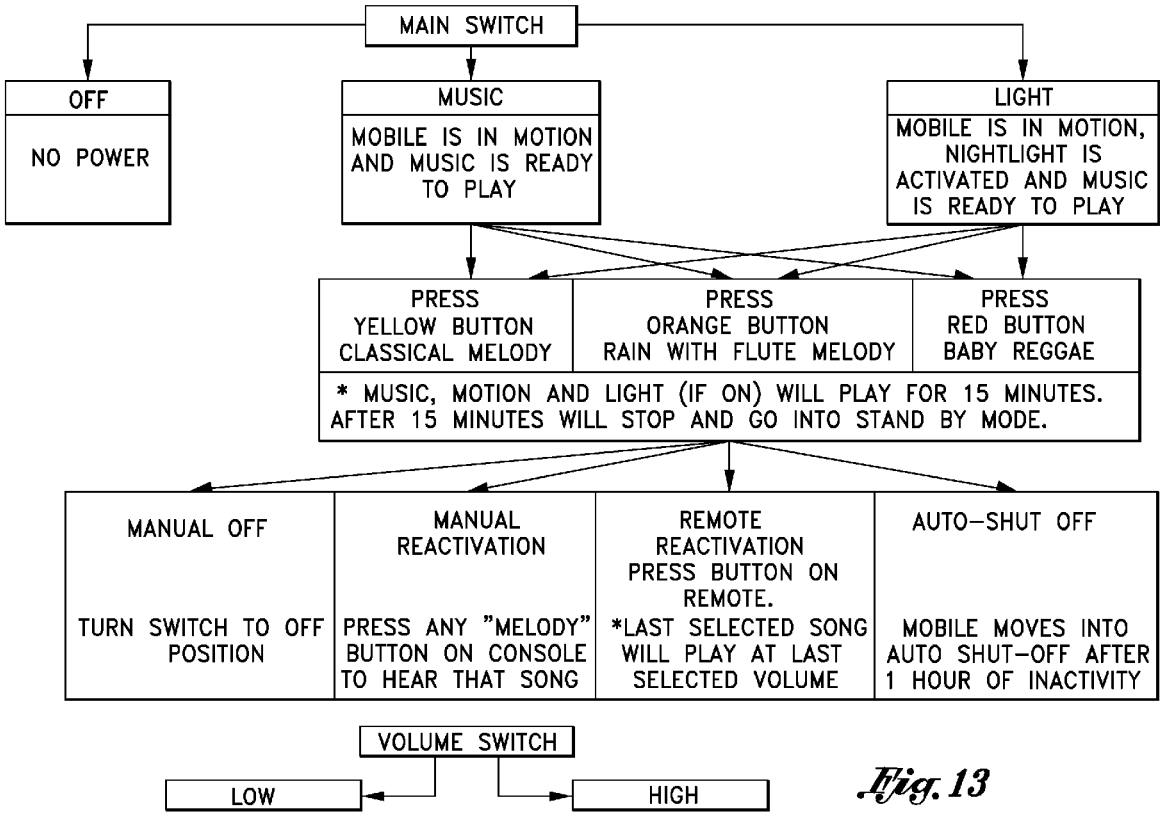
FIG. 13 is a flow chart illustrating the operational modes of the crib mobile.

Operation of the crib mobile 10 is now described with reference to the flow chart of FIG. 13 schematically illustrating the use of the on/off switch 26, melody control buttons 32, volume control 28 and nightlight 30 as well as the use of the remote control 96. As can be seen in FIG. 13, the main switch may be activated on the base assembly 18 to provide power from the battery 22 to the motor 62 and thereby place the support frame 66 into rotary motion. Activation of the light 30 switch causes the nightlight 30 to illuminate as described above. Selective activation of one of the three control buttons 32 results in the playing of a particular type of melody such as a classical melody, flute melody and/or baby reggae melody, depending upon which control button 32 is selected.

The crib mobile 10 may optionally be configured to remain in a powered state for a predetermined period of time such as, for example, fifteen minutes. Alternatively, the crib mobile 10 may be configured or preprogrammed to operate on a continuous basis or under various other operational modes such as on a periodic basis (e.g., for five minutes every hour). Additionally, the crib mobile 10 may be configured to go into a "standby" mode after a predetermined operational period. During this "standby" period, the motor 62 may be temporarily deactivated. Furthermore, the crib mobile 10 may be provided with an automatic shut-off feature wherein after a predetermined period of time (e.g., one hour) of inactivity, the crib mobile 10 is powered down to preserve battery 22 power.

In the "standby" mode, the on/off switch 26 may be moved to the "off" position, or any one of the control buttons 32 may be selectively activated in order to cause the crib mobile 10 to play a desired melody. The remote control 96 may be utilized to cause the crib mobile 10 to repeat the type of melody previously selected. The volume control 28 may adjusted at any time. During reactivation of the melody via the remote control 96, such melodies are played at the previously selected volume.

Additional modifications and improvements of the present invention may also be apparent to those of ordinary skill in the art. Thus, the particular combination of parts described and illustrated herein is intended to represent only certain embodiments of the present invention and is not intended to serve as limitations of alternative devices within the spirit and scope of the invention.

What is claimed:

1. A crib mobile, comprising:

a base assembly;

an arcuately-shaped elongate support bar having proximal and distal ends and extending outwardly from the base portion at the proximal end;

a body assembly mounted on the distal end of the support bar and including a body housing containing a motor therewithin having a protruding drive shaft;

a support frame mounted on the drive shaft, the support frame being configured in a clover-leaf configuration comprising a plurality of contiguous lobes which each include an outer rim defining an opening and an arm member which is attached to the outer rim and protrudes into the opening defined thereby; and a plurality of character elements mounted on the support frame.

2. The crib mobile of claim 1 wherein:

the support frame is of unitary construction;

the outer rim of each of the lobes is arcuately-shaped, with the arm member extending radially inwardly therefrom toward a center of the opening;

each one of the arm members has a respective one of the character elements mounted thereon.

3. The crib mobile of claim 2 wherein the support frame includes three lobes oriented at an angular spacing of about one-hundred-twenty degrees relative to one another.

4. The crib mobile of claim 3 wherein each one of the character elements is pivotally supported on a free end of a respective one of the arm members.

5. The crib mobile of claim 3 wherein:

adjacent pairs of the lobes define a notch therebetween;

a hollow object is mounted to the support frame at each one of the notches; and each one of the hollow objects is at least partially filled with a plurality of beads.

6. The crib mobile of claim 5 wherein the hollow objects are fixedly mounted to the support frame and are configured such that the beads move within each of the hollow objects during rotation of the support frame.

7. The crib mobile of claim 1 further comprising a clamp mechanism included with the base assembly and adapted to removably mount the base assembly to a support structure.

8. The crib mobile of claim 7 wherein the clamp mechanism includes:

a recess formed in the base housing; and a rotatable clamp knob having a threaded shaft extending into the base housing and including a clamp pad;

the clamp pad and recess defining a gap therebetween and being axially movable relative to one another during rotation of the clamp knob such that the base assembly is securable to the support structure.

9. The crib mobile of claim 2 wherein:

the base assembly includes:

a base housing having a battery contained therewithin and electrically connected to the motor; and an on/off switch electrically connected to the battery and operative to activate the motor for effectuating rotation of the support frame.

10. The crib mobile of claim 1 wherein the base assembly includes a speaker and speaker holes, the base assembly being selectively operative to cause the speaker to reproduce music for transmission through the speaker holes.

11. The crib mobile of claim 1 wherein:

at least one of the character elements includes a musical instrument attached thereto;

the character element including at least one movable member being configured to move in response to gravitational force acting thereupon during rotation of the support frame to simulate the playing of the musical instrument.

12. The crib mobile of claim 1 wherein the base assembly includes a plurality of control buttons adapted to allow regulate operation of the crib mobile.

13. The crib mobile of claim 1 further comprising a remote control operative to regulate operation of the motor.

14. The crib mobile of claim 2 wherein:

the support frame defines a plane of rotation;

each of the character elements includes a body portion which is rotatably mounted to a respective one of the arm members;

the plane of rotation of the body portion is parallel to the plane of rotation of the support frame;

the body portion includes at least one peripheral portion pivotally attached thereto;

the plane of rotation of the peripheral portion is parallel to the plane of rotation of the support frame.

15. The crib mobile of claim 14 wherein:

each of the character elements is configured to simulate the appearance of an animal having a head portion fixedly secured to the body portion;

the head portion of each of the character elements has a pair of peripheral portions configured to simulate the appearance of animal ears;

the body portion of each of the character elements has a pair of peripheral portions configured to simulate the appearance of animal legs; and each one of the ears and legs is adapted to freely pivot relative to one another during rotation of the support frame in response to gravitational force acting upon the ears and legs.

16. A crib mobile, comprising:

a base assembly;

an arcuately-shaped elongate support bar having proximal and distal ends and extending outwardly from the base portion at the proximal end;

a body assembly mounted on the distal end of the support bar and including a body housing containing a motor therewithin having a protruding drive shaft;

a support frame mounted on the drive shaft, the support frame being configured in a clover-leaf configuration comprising a plurality of contiguous lobes which each include an outer rim defining an opening and an arm member which is attached to the outer rim and protrudes into the opening defined thereby;

a plurality of character elements mounted on the support frame;

a musical instrument mounted to each one of the character elements; and at least one movable member being attached to each one of the character elements, the movable member being configured to move in response to gravitational force acting thereupon during rotation of the support frame to simulate the playing of the musical instrument.

17. The crib mobile of claim 16 wherein:

the base assembly includes a speaker and speaker holes, the base assembly being selectively operative to cause the speaker to produce music for transmission through the speaker holes.

18. A crib mobile for a crib having a crib railing, comprising:

a base assembly including a base housing having a battery contained therewithin, the base assembly being adapted to be removably mounted to the crib railing;

an arcuately-shaped elongate hollow support bar having proximal and distal ends and extending outwardly from the base assembly at the proximal end, the support bar comprising a pair of bar portions connectable by a hinge and being adapted to allow folding of the bar portions in relation to one another;

a body assembly mounted on the distal end of the support bar and including a body housing having a motor disposed therewithin having a protruding drive shaft, the motor being electrically connected to the battery;

a support frame mechanically connected to the drive shaft; and a plurality of character elements mounted on the support frame, each of the character elements being configured to simulate the appearance of an animal and including:

a body portion having a pair of peripheral portions pivotally attached thereto and being configured to simulate the appearance of animal legs; and a head portion fixedly secured to the body portion and having a pair of peripheral portions pivotally attached to the head portion, the peripheral portions attached to the head portion being configured to simulate the appearance of animal ears;

wherein:

each one of the ears and legs is adapted to freely pivot relative to one another during rotation of the support frame in response to gravitational force acting upon the ears and legs;

the support frame comprising a plurality of contiguous lobes which each have a circularly-configured opening formed therein, each of the lobes comprising a circularly-shaped outer rim having an elongate arm member extending radially inwardly therefrom and terminating at a center of the opening, each one of the arm members having the body portion of a respective one of the character elements rotatably mounted thereon.

* * * * *